US006520224B2

(12) United States Patent
Smith

(10) Patent No.: US 6,520,224 B2
(45) Date of Patent: Feb. 18, 2003

(54) POWER TOOL MOUNTING PLATE

(75) Inventor: Darrin E. Smith, Penetanguishene (CA)

(73) Assignee: Jessem Products Limited, Barrie Ontario (CA)

( * ) Notice: Subject to any disclaimer, the term of this patent is extended or adjusted under 35 U.S.C. 154(b) by 0 days.

(21) Appl. No.: 10/023,821

(22) Filed: Dec. 21, 2001

(65) Prior Publication Data

US 2002/0079021 A1 Jun. 27, 2002

(51) Int. Cl.[7] ..... B27C 5/00
(52) U.S. Cl. ..... 144/135.2; 144/137; 144/286.5
(58) Field of Search ..... 144/1.1, 2.1, 134.1, 144/135.2, 137, 136.1, 136.95, 154.5, 286.1, 286.5; 409/226, 180, 181, 182; 83/477.2

(56) References Cited

U.S. PATENT DOCUMENTS 4,484,608 A 11/1984 Ferdinand et al.
4,635,692 A * 1/1987 Hulse et al. ..... 144/286.1
4,679,606 A * 7/1987 Bassett ..... 144/286.5
4,774,986 A * 10/1988 La Gra ..... 144/286.1
4,977,938 A 12/1990 Greeson
5,289,861 A 3/1994 Hedrick
5,398,740 A 3/1995 Miller
6,305,447 B1 * 10/2001 Rousseau ..... 144/286.1
6,382,276 B1 * 5/2002 Daniels et al. ..... 144/135.2

* cited by examiner

*Primary Examiner*—W. Donald Bray
(74) *Attorney, Agent, or Firm*—Birch, Stewart, Kolasch & Birch, LLP

(57) ABSTRACT

The mounting plate includes an upper panel having an aperture for receipt of the cutting implement of a power tool such as a bit or a saw. The panel is adapted to be received in the opening for an insert formed in the work bench where its upper surface is flush with the working surface of the bench. A sub-panel is attached to the lower surface of the upper panel and has a number of slots for receipt of screws for inter-connecting the sub-panel and the mounting ring or base of the power tool. The screws do not extend to the upper surface of the upper panel where they would interfere with the operation of the power tool. The mounting plate has one or more anchor brackets for interconnecting the sub-panel to the upper panel so that the sub-panel does not rotate relative to the upper panel. The mounting plate may be connected to the base of a power tool having a wide variation of hole patterns.

19 Claims, 7 Drawing Sheets

72
74
70
62
68
28
36
64a
34
30
76
68
32
62
58
54b
52
54a
56
40
44
42
55
54
66
15
68
64

FIG.10.
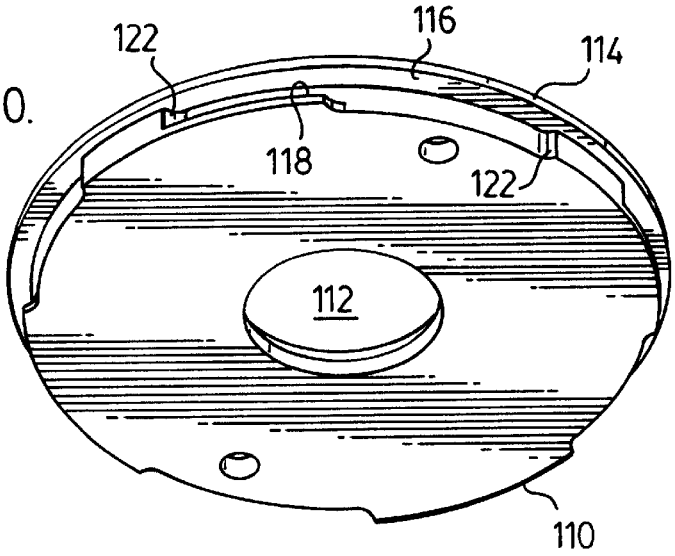
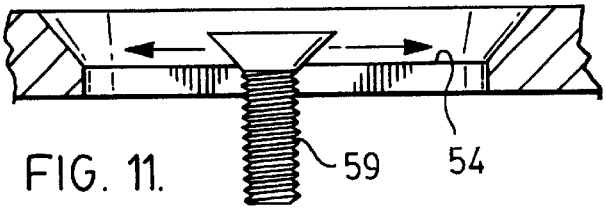
FIG. 11.
FIG. 12.
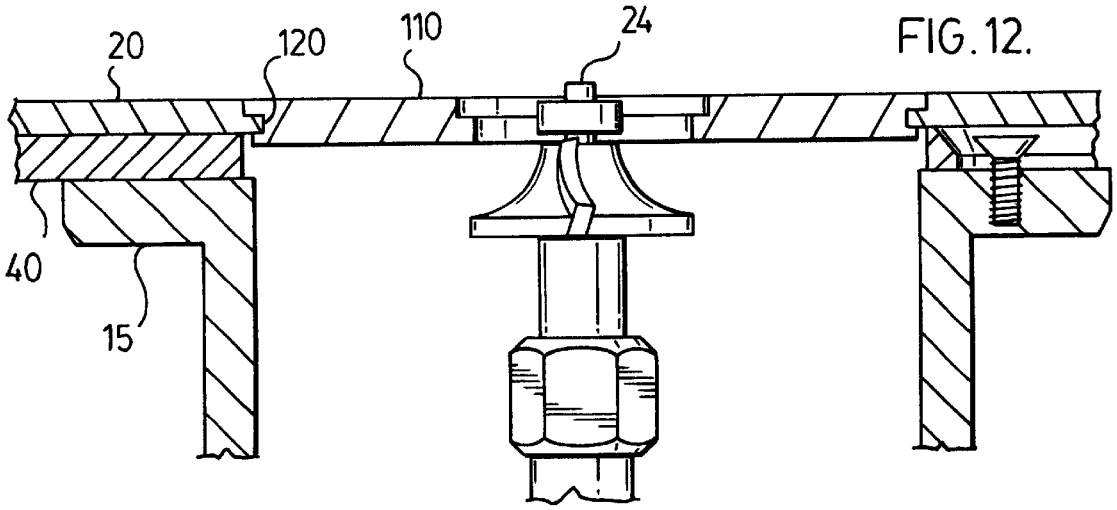

POWER TOOL MOUNTING PLATE

BACKGROUND OF THE INVENTION

This invention relates to mounting plates for power tools and more particularly to a universal mounting plate for mounting power tools of a wide variety of designs beneath the working surface of a work bench.

A power tool such as a router or saw usually has threaded holes on its base or mounting ring and is attached to the underside of an insert on a work bench by means of screws or bolts. There is no universal standard for the size or the pattern of holes in the base of the tool and for that reason, the insert in some cases is provided with many holes so that no matter what the pattern of holes in the base, holes can usually be found in the insert in registry with those in the base. In other cases, the inserts are provided with no holes at all and in this case, holes must be drilled in the inserts to line up with the holes in the base of the power tool.

A shortcoming of inserts with many holes is that each hole is a site for waste such as wood shavings, dust and other by-products of whatever operation is being carried out on the work bench. As the waste builds up in the holes, the inserts become more and more bumpy and irregular and difficult to work on. These holes may also prevent the stock on the work bench from sliding easily over the working surface.

A shortcoming of inserts without holes is that time and considerable skill are required to prepare them for attachment to the base of a power tool. The typical user of such tool does not have such skill and it is usually quite inconvenient for him to find a person who does.

SUMMARY OF THE INVENTION

I have devised a mounting plate which is used in place of a conventional insert in a work bench. The mounting plate may be connected to the base of a power tool having a wide variation of pattern of holes. Briefly my mounting plate comprises an upper panel having an aperture for receipt of the cutting implement of a power tool such as a bit or a saw. The upper panel is adapted to be received in the opening for an insert formed in the work bench such that the upper surface of the upper panel is flush with the working surface of the bench. The lower surface of the upper panel has a cavity for removable receipt of a sub-panel. The cavity has an upper face which is spaced apart from the upper surface of the upper panel. When the sub-panel is in the cavity, it is substantially immovable. The sub-panel has a number of slots and circular holes for removable receipt of fasteners for inter-connecting the sub-panel and the base of the power tool. The upper surface of the cavity separates the fasteners from the upper surface of the upper panel so that the fasteners do not interfere with the operation of the power tool. The mounting plate has at least one anchor bracket for removably confining the sub-panel within the cavity.

The mounting plate may alternatively have a sub-panel disposed beneath the upper panel and means for securing the sub-panel to the upper panel so that the sub-panel is substantially immovable relative to the upper panel. The sub-panel has a number of holes formed therein for removable receipt of fasteners for interconnecting the sub-panel and the base. The lower surface of the upper panel defines a barrier which separates the fasteners from the upper surface of the upper panel and which confines the fasteners beneath the upper surface.

DESCRIPTION OF THE DRAWINGS

The mounting plate of the invention is described with reference to the accompanying drawings in which:

FIG. 10 is a perspective view of an annular fitting for insertion into the mounting plate;

FIG. 11 is a side view of a the fitting and upper panel of the mounting plate;

FIG. 12 is a section of the mounting plate in conjunction with a router and a work bench.

Like reference characters refer to like parts throughout the description of the drawings.

DESCRIPTION OF PREFERRED EMBODIMENTS

Figure 1:
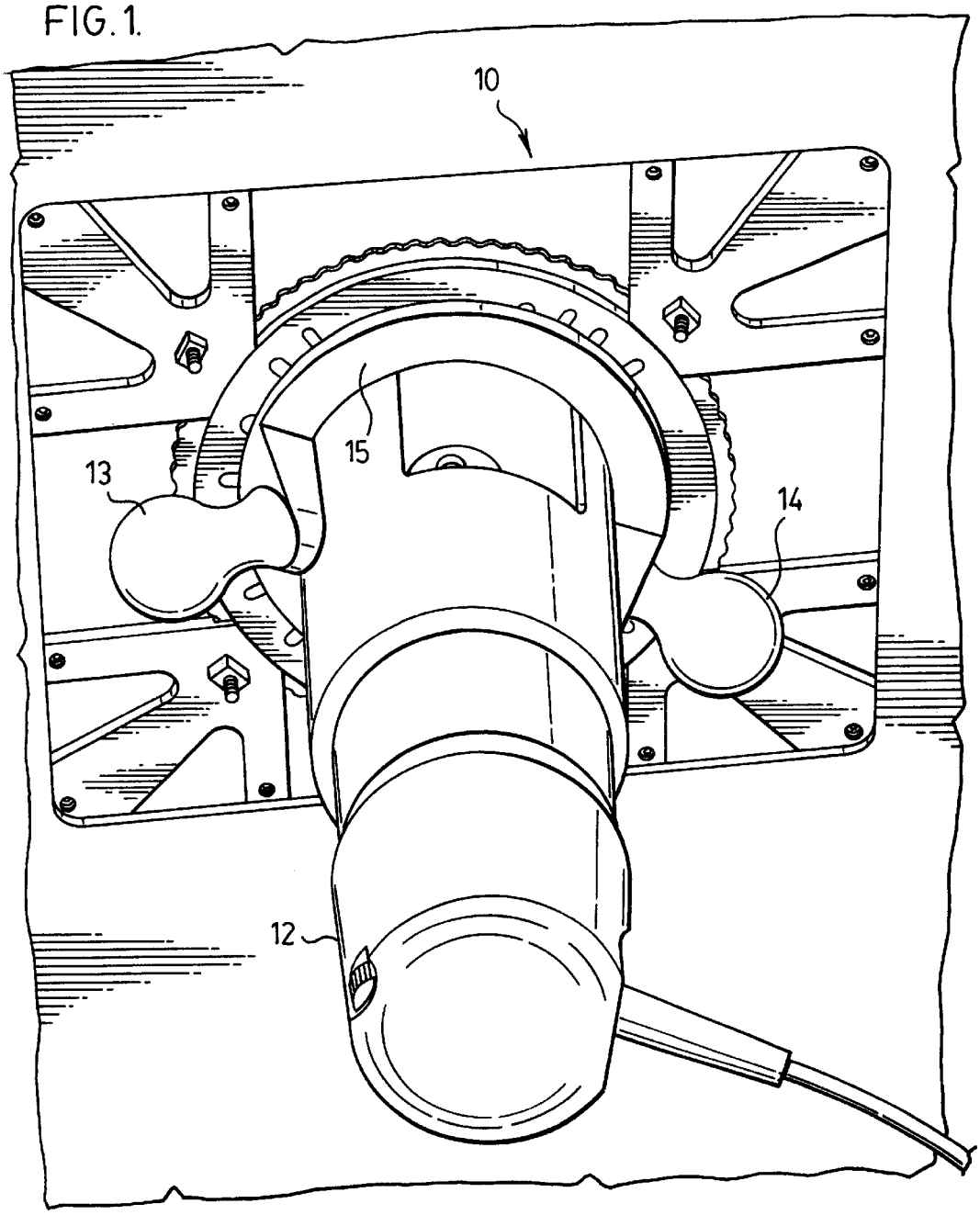
FIG. 1 is a perspective view of the mounting plate in conjunction with a router.

With reference to FIG. 1, the mounting plate of the invention, indicated generally 10, is shown in conjunction with a conventional router 12. The router has a pair of diametrically opposite handles 13, 14 and a base or mounting ring 15 which is attached to the mounting plate in the manner described below.

While the power tool illustrated and described in this application is a router, it is to be understood that the mounting plate of the invention can be used in conjunction with other power tools such as power saws. Where a power tool is attached beneath the working surface of a bench and where the tool has a working implement such as a bit or a saw which projects upwardly from the working surface, the mounting plate of the invention may be usefully employed to attach it to a work bench.

Figure 2:
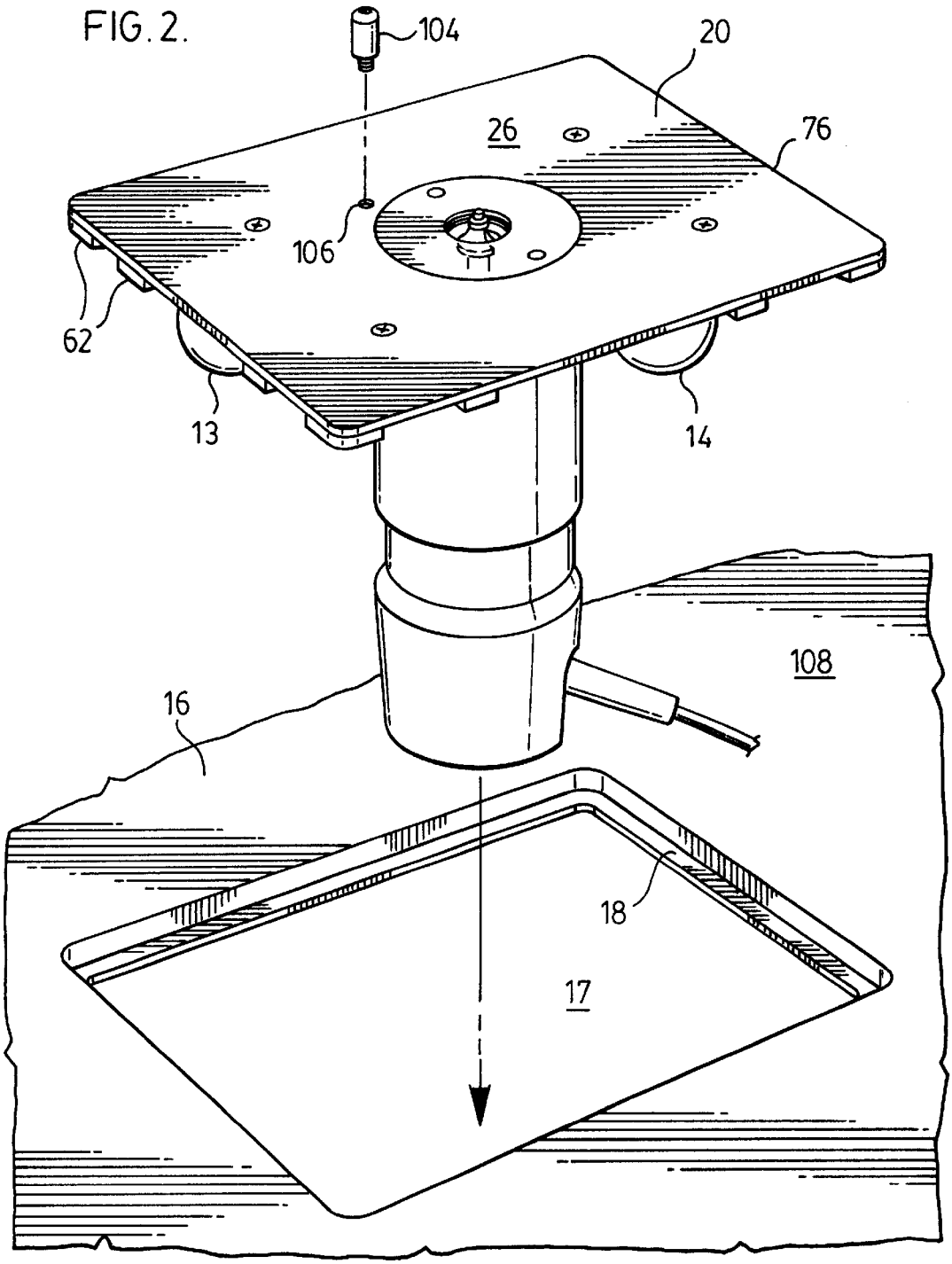
FIG. 2 is a perspective view of the mounting plate, router and working surface of a work bench.

With reference to FIG. 2, the mounting plate is connected to the router and is located above the working surface 16 of a conventional work bench. As is usual, a rectangular opening 17 is provided for an insert and a ledge 18 is formed along the edge that defines the opening.

Figure 3:
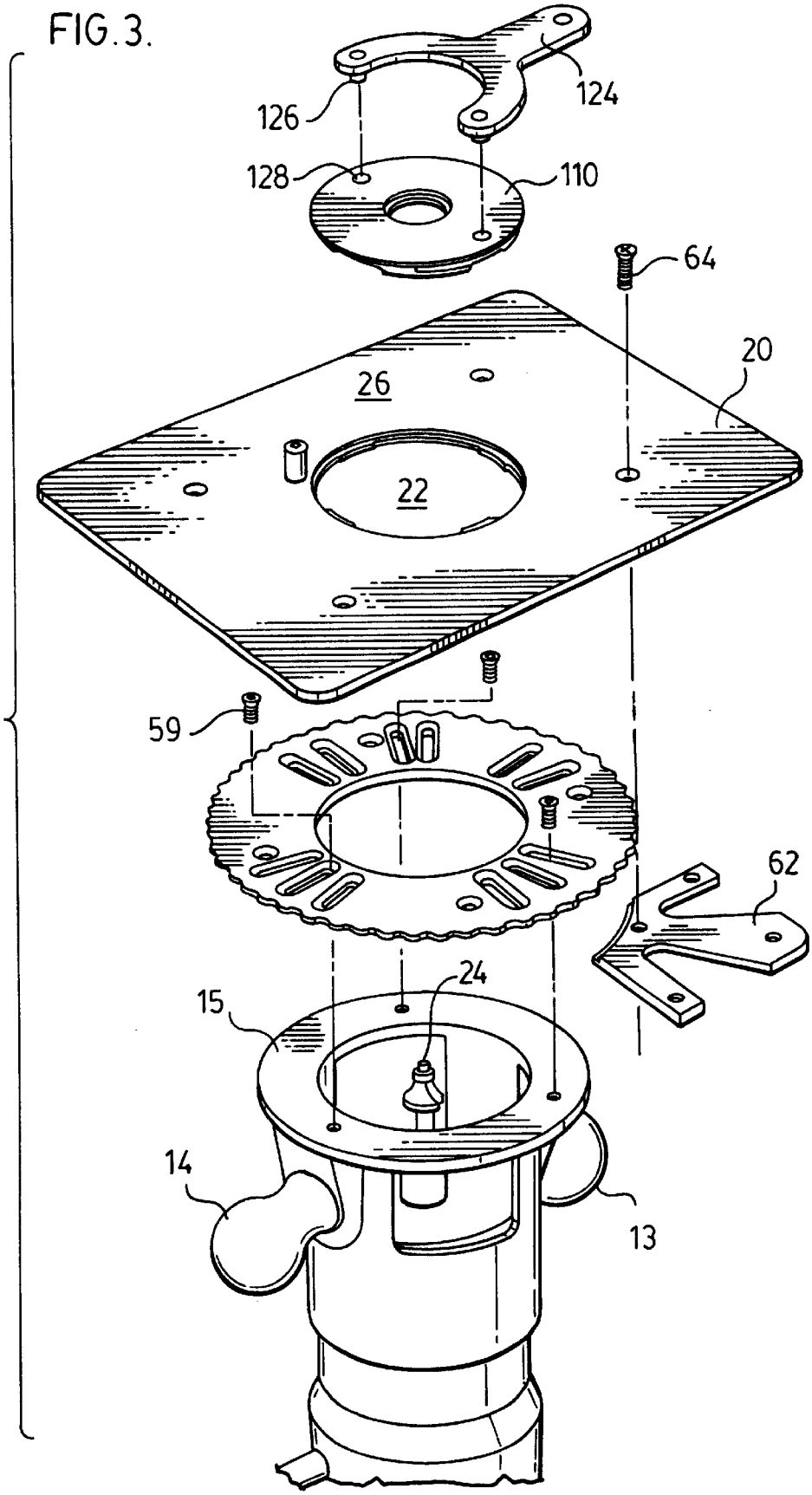
FIG. 3 is an exploded perspective view of the mounting plate looking downwardly onto the upper side of it.
Figure 4:
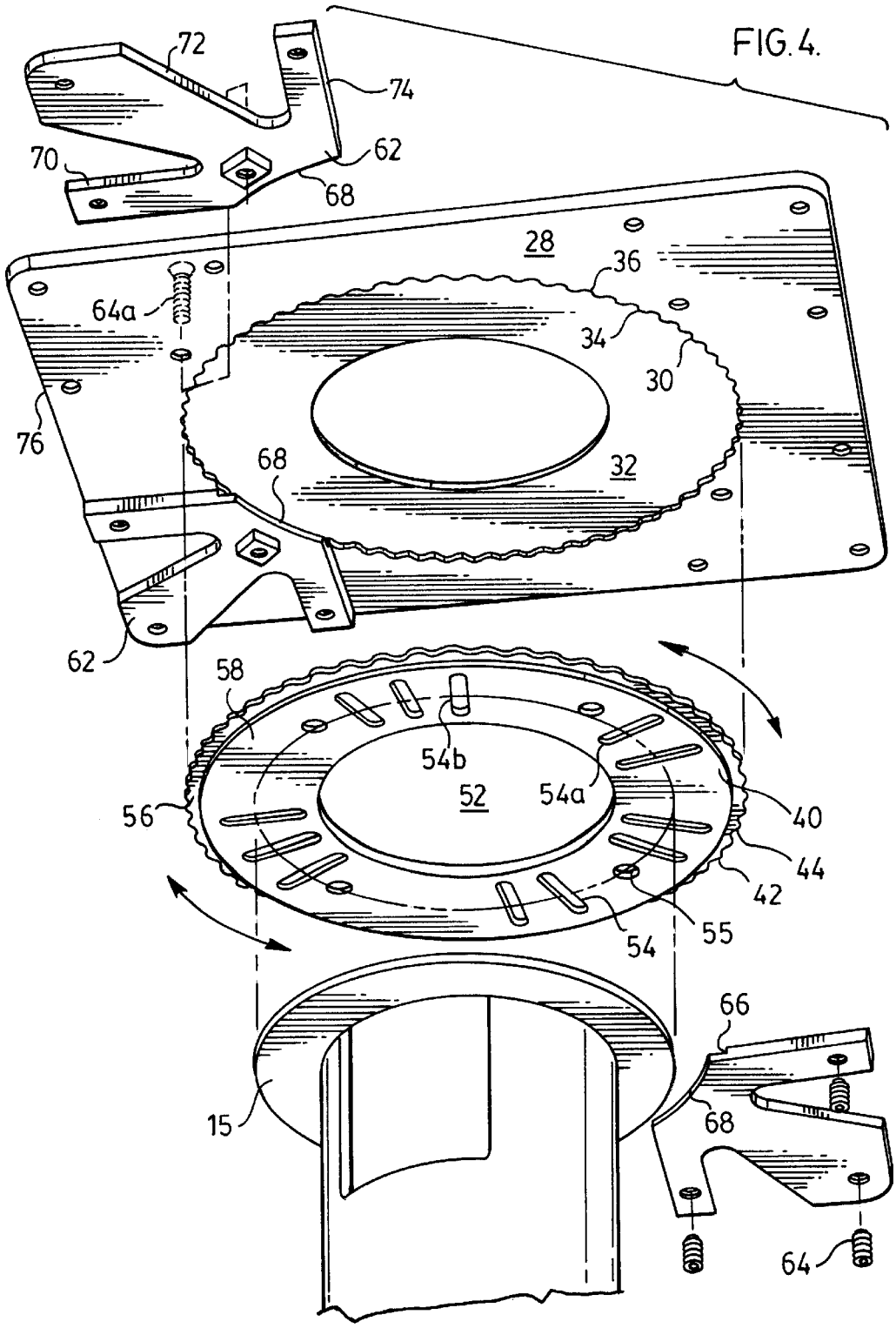
FIG. 4 is another perspective view of the mounting plate looking upwardly from the lower side of it.

With reference to FIGS. 3 and 4, the mounting plate has an upper panel 20 having a central aperture 22 for receipt of bit 24 of the router. The upper panel has oppositely facing upper and lower surfaces 26, 28.

A circular cavity 30 is formed in the lower surface of the upper panel. The cavity opens upwardly from the lower surface and terminates at an upper face 32 which is spaced apart and beneath the upper surface 26 of the upper panel. The lateral boundary of the cavity is defined by a circular outer edge along which ridges 34 interposed by grooves 36 are formed. The edge accordingly has a scalloped, knurled or serrated configuration.

A circular sub-panel 40 is removably received in the cavity. Like the edge of the cavity, the sub-panel has a scalloped, knurled or serrated outer edge made up of ridges 42 and grooves 44. The outer diameter of the sub-panel is slightly less than the diameter of the cavity so that the sub-panel can be easily inserted and removed from the cavity. When the sub-panel is in the cavity however, its grooves and ridges are received in the ridges and grooves of the cavity respectively. As a result, the sub-panel cannot rotate in the cavity.

The sub-panel has a circular central aperture 52 through which the bit 24 of the router extends. The sub-panel also has a plurality of holes, some shaped as slots 54 and others 55 being circular. The slots extend radially and are arranged in groups of two's 54*a* and three's 54*b* spaced relatively closely beside each other. The circular holes are located between adjacent groups of slots.

The sub-panel is made up of upper and lower circular plates 56, 58, the upper having the scalloped, knurled or serrated outer edge and the latter being of smaller diameter and having a smooth outer edge. The sub-panel may be two plates which are connected permanently to each other or a single piece formed to the shape illustrated in FIG. 4.

The sub-panel is attached to base 15 of the router by fasteners such as screws 59 (FIG. 3) which pass downwardly through the slots and circular holes and into threaded screw holes in base 15. As illustrated in FIG. 11, the diameter of the heads of the screws is greater than the width of the slots so that when the screws are tightened, their heads remain in the slots and openings and interconnect the sub-panel with the base of the router.

The upper face 32 of the cavity defines a partition between the screws and the upper surface 26 of the upper panel. It also acts as a barrier since it prevents the screws from rising above the upper face to the level of the upper surface of the upper panel where they will interfere with the routing operation.

To attach the sub-panel to the base of the router, the sub-panel is first removed from the cavity in the upper panel and is placed on top of the base. The sub-panel is then rotated until its slots and holes line up with the holes in the base. Screws 59 are then inserted through the slots and holes and into the holes in the base and are tightened.

The arrangement of slots and holes in the sub-panel makes it possible to attach the mounting plate to the bases of most routers no matter where the screw holes are located in the bases.

The sub-panel is then placed beneath the upper panel 20 of the mounting plate and is rotated until the router may be lowered through rectangular opening 17 in the work bench without interference by handles 13, 14. The arrow in FIG. 2 indicates the direction of such movement. Finally, the sub-panel is inserted into the cavity of the upper panel and secured therein by means of anchor brackets described below.

It should be noted that when the sub-panel is within the cavity, screws 59 which interconnect the sub-panel to be base are also within the cavity and do not extend to the upper surface 26 of the upper panel. The screws, slots and circular holes in the sub-panel are not therefore a site for waste generated on the working surface of the bench.

With reference again to FIGS. 3 and 4, an anchor bracket 62 is attached by screws 64 to each corner of the lower surface of the upper panel. As illustrated in the lower bracket in FIG. 4, the bracket has a stepped circular inner edge composed of an upper portion 66 which is slightly outside cavity 30 and a lower portion or lip 68 which extends into the cavity. The lip engages the sub-panel when it is within the cavity and confines it therein unless the anchor bracket is disconnected from the upper panel.

Figure 9:
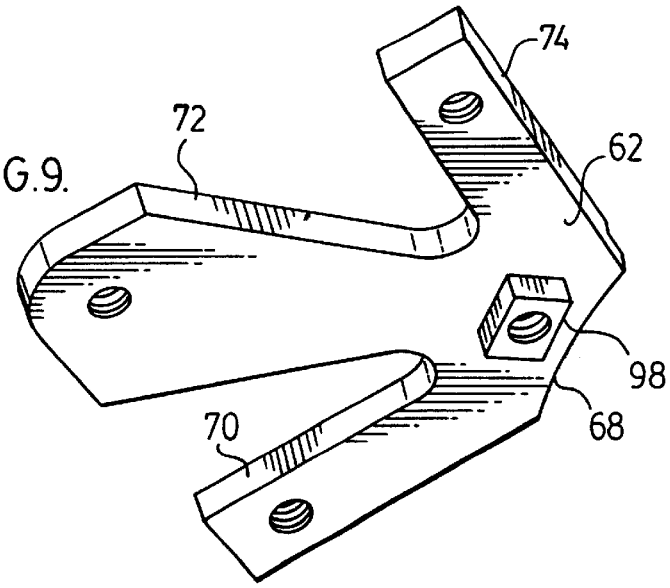
FIG. 9 is a perspective view of the anchor bracket.

With reference to FIGS. 4 and 9, the bracket has three fingers 70, 72 and 74 which extend from the inner edge and terminate at the outer edges 76 of the upper panel.

Figure 5:
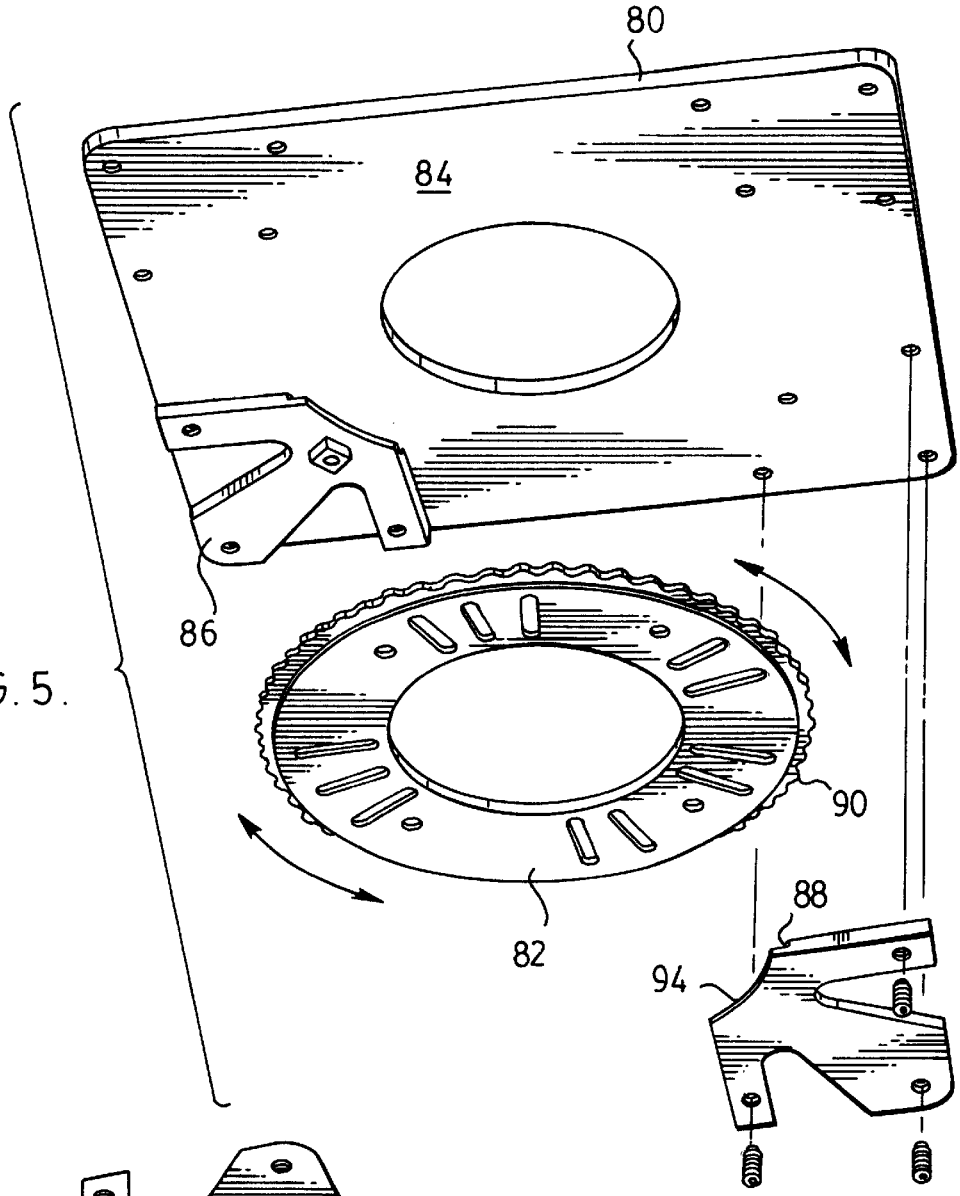
FIG. 5 is a perspective view of a second embodiment of the mounting plate looking upwardly from the lower side.

With reference to FIG. 5, the upper panel 80 and the sub-panel 82 are the same as those illustrated in the previous figures except that the upper panel lacks a cavity in its lower surface 84. The upper and lower surfaces of the upper panel are planar and parallel to each other throughout their extent unlike the upper and lower surfaces of the upper panel illustrated in FIG. 4.

Figure 6:
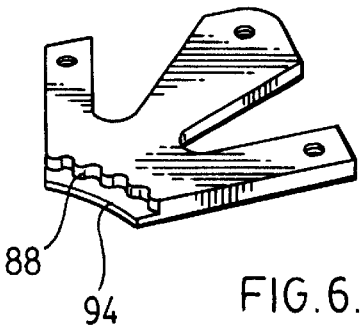
FIG. 6 is a perspective view of the upper side of the lowermost anchor bracket shown in FIG. 5.

Sub-panel 82 is connected to the upper panel by means of the anchor brackets 86 illustrated in FIG. 5 and ones like it at the other comers of the upper panel. The anchor bracket has the same construction as bracket 66 except that, as illustrated in FIG. 6, its inner edge has an upper portion 88 which is scalloped, knurled or serrated. That edge portion cooperates with the scalloped, knurled or serrated outer edge 90 of the sub-panel to prevent the sub-panel from rotating relative to the upper panel. Thus the anchor brackets serve as means for securing the sub-panel to the upper panel so that the sub-panel is substantially immovable relative to the upper panel.

The lower portion of the inner edge of the anchor bracket, like bracket 66, is stepped radially outward at 94 to secure the sub-panel to the upper panel.

The lower surface of the upper panel defines a barrier between the screws which connect the sub-panel to the base of the power tool and the upper surface of the upper panel. The lower surface thus acts as a barrier since it prevents the screws from rising to the upper surface where they will interfere with the routing operation.

Figure 7:
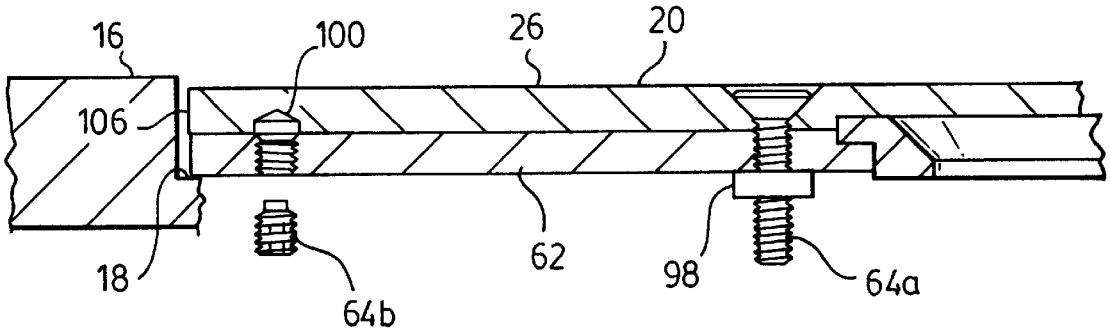
FIGS. 7 and 8 are side views of the anchor bracket and upper panel.
Figure 8:
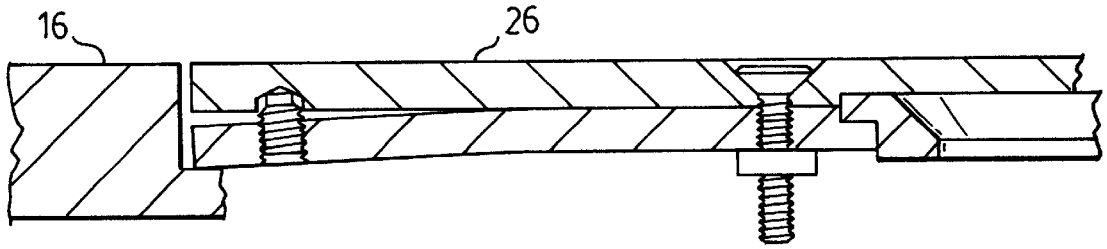

With reference to FIGS. 7 to 9, stud 64*a* cooperates with square nut 98 to interconnect the anchor bracket to the upper panel 20 whereas stud 64*b* serves to separate them. The latter stud extends upwardly through a threaded aperture in the anchor bracket and into a hollow 100 in upper panel 20. When stud 64*b* is tightened, the upper panel is forced upward by the stud and separates from the anchor bracket as illustrated in FIG. 8. The purpose of this is described below.

With reference to FIGS. 7 and 2, the outer edge 106 of upper panel 20 is of the same shape as the insert and fits into opening 17. When in the opening, the anchor brackets 62 rest on ledge 18 so that the panel remains in the opening. A start pin 104 is threadably received in a tapped hole 106 in the upper panel.

The upper surface 26 of the upper panel should be flush with the working surface 108 of the bench. If it is not, studs 64*b* in the anchor brackets can be used to make it so. If, for example, one corner of the upper surface 26 of the upper panel is below the level of the adjacent area of the working surface, stud 64*b* in the bracket at that corner can be tightened, as illustrated in FIG. 8, in order to raise the level of the upper panel at that corner.

With reference to FIGS. 3, 10 and 11, an annular fitting 110 serves to decrease the effective diameter of aperture 22 in the upper panel. The fitting has a central opening 112 and a circular outer surface 114. A groove defined by upper and lower rims 116,118 respectively is formed on the outer surface for receipt of a ridge 120 on the circular edge which defines circular aperture 22 in the upper panel. The groove is separated into segments as at 122 as is the ridge so that the fitting may be inserted into aperture 22 and secured therein by turning of the fitting until the ridge segments of the upper panel enter the groove segments of the fitting.

As illustrated in FIG. 3, to facilitate turning of the fitting, handle 124 is provided. The handle has pins 126 which fit into openings 128 in the fitting.

It will be understood of course that modifications can be made in the preferred embodiment illustrated and described herein without departing from the scope of the invention as defined in the appended claims.

I claim:

1. A mounting plate adapted to mount a power tool beneath the working surface of a work table, said power tool having a cutting implement and a base for affixing said tool during use and said working surface having an opening formed therein, said mounting plate comprising:

an upper panel having an aperture for receipt of said cutting implement and oppositely facing upper and lower surfaces, said mounting plate being adapted to be received in said opening in said working surface such that said upper surface is flush with said working surface, said mounting plate having a downwardly opening cavity formed therein, said cavity extending upwardly from said lower surface and terminating short of said upper surface at an upper face spaced apart from and beneath said upper surface of said upper panel;

a sub-panel removably receivable in said cavity and when so received being substantially immovable therein, said sub-panel having a plurality of holes formed therein for removable receipt of fasteners for interconnecting said sub-panel and said base, said upper face defining a barrier which separates said fasteners from said upper surface and which confines said fasteners beneath said upper surface.

2. A mounting plate as claimed in claim 1 wherein said cavity has a lateral boundary defined by a circular outer edge in which a plurality of grooves interposed by ridges is formed and said sub-panel has a circular outer edge along which a plurality of grooves interposed by ridges is formed, the grooves and ridges of said sub-panel being accommodated in the ridges and grooves of said cavity respectively when said sub-panel is within said cavity such that rotation of said sub-panel within said cavity is prevented.

3. The mounting plate as claimed in claim 1 wherein said holes are slot-shaped.

4. The mounting plate as claimed in claim 1 wherein said slot-shaped holes are radially extending.

5. The mounting plate as claimed in claim 1 wherein some of said holes are slot-shaped and others are circular.

6. The mounting plate as claimed in claim 1 further including means for raising and lowering the level of said upper panel within said opening.

7. The mounting plate as claimed in claim 1 further including at least one anchor bracket for confining said sub-panel within said cavity, said bracket being affixed to said lower surface of said upper panel.

8. The mounting plate as claimed in claim 7 wherein said anchor bracket has a stud threadably received therein which, upon rotation in one direction, moves into contact with said upper panel and causes said upper panel to separate from said anchor bracket with resulting raising of said upper panel in said opening.

9. The mounting plate as claimed in claim 1 further including a fitting for reducing the effective size of said aperture and for removable insertion therein, said fitting having an outer edge in which a groove is formed, said opening being defined by a surface having a ridge formed therein, the groove of said fitting cooperating with the ridge of said opening to removably confine said fitting in said opening.

10. A mounting plate adapted to mount a power tool beneath the working surface of a work table, said power tool having a cutting implement and a base for affixing said tool during use and said working surface having an opening formed therein, said mounting plate comprising:

an upper panel having an aperture for receipt of said cutting implement and oppositely facing upper and lower surfaces, said mounting plate being adapted to be received in said opening in said working surface such that said upper surface is flush with said working surface, a sub-panel disposed beneath said upper panel;

means for securing said sub-panel to said upper panel such that said sub-panel is substantially immovable relative to said upper panel, said sub-panel having a plurality of holes formed therein for removable receipt of fasteners for interconnecting said sub-panel and said base, said lower surface defining a barrier which separates said fasteners from said upper surface and which confines said fasteners beneath said upper surface.

11. A mounting plate as claimed in claim 10 wherein said sub-panel has a circular outer edge in which a plurality of grooves interposed by ridges is formed and said securing means has a circular outer edge along which a plurality of grooves interposed by ridges is formed, the grooves and ridges of said sub-panel being accommodated in the ridges and grooves of said securing means respectively when said sub-panel is secured to said upper panel such that rotation of said sub-panel relative to said upper panel is prevented.

12. The mounting plate as claimed in claim 10 wherein said holes are slot-shaped.

13. The mounting plate as claimed in claim 10 wherein said slot-shaped holes are radially extending.

14. The mounting plate as claimed in claim 10 wherein some of said holes are slot-shaped and others are circular.

15. The mounting plate as claimed in claim 10 further including means for raising and lowering the level of said upper panel within said opening.

16. The mounting plate as claimed in claim 10 wherein said securing means is an anchor bracket affixed to said lower surface of said upper panel.

17. The mounting plate as claimed in claim 10 wherein said sub-panel has a circular outer edge in which a plurality of grooves interposed by ridges is formed and said securing means is an anchor bracket affixed to said lower surface of said upper panel, said anchor bracket having a stepped inner edge composed of an upper portion in which a plurality of grooves interposed by ridges is formed and a lower portion which extends beneath and supports said sub-panel such that said sub-panel is prevented from separating from said upper panel, the grooves and ridges of said sub-panel being accommodated in the ridges and grooves of said anchor bracket respectively such that rotation of said sub-panel relative to said upper panel is prevented.

18. The mounting plate as claimed in claim 16 wherein said anchor bracket has a stud threadably received therein which, upon rotation in one direction, moves into contact with said upper panel and causes said upper panel to separate from said anchor bracket with resulting raising of said upper panel in said opening.

19. The mounting plate as claimed in claim 10 further including a fitting for reducing the effective size of said aperture and for removable insertion therein, said fitting having an outer edge in which a groove is formed, said aperture being defined by a surface having a ridge formed therein, the groove of said fitting cooperating with the ridge of said aperture to removably confine said fitting in said aperture.

* * * * *

UNITED STATES PATENT AND TRADEMARK OFFICE

CERTIFICATE OF CORRECTION

PATENT NO. : 6,520,224 B2
DATED : February 18, 2003
INVENTOR(S) : Darrin Smith

It is certified that error appears in the above-identified patent and that said Letters Patent is hereby corrected as shown below:

Title page,
Add the following Item:
-- [30] Foreign Application Priority Data
December 12, 2000 Canada 2,334,067..... --

Signed and Sealed this

Eighteenth Day of November, 2003

JAMES E. ROGAN
*Director of the United States Patent and Trademark Office*